US006784423B2

(12) United States Patent
Reents, Jr. et al.

(10) Patent No.: US 6,784,423 B2
(45) Date of Patent: Aug. 31, 2004

(54) CHARACTERIZATION OF INDIVIDUAL PARTICLE ATOMIC COMPOSITION BY AEROSOL MASS SPECTROMETRY

(75) Inventors: William David Reents, Jr., Middlesex, NJ (US); Michael J Schabel, Clark, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 16 days.

(21) Appl. No.: 10/251,352

(22) Filed: Sep. 20, 2002

(65) Prior Publication Data

US 2004/0056188 A1 Mar. 25, 2004

(51) Int. Cl.[7] ..... H01J 49/00
(52) U.S. Cl. ..... 250/287
(58) Field of Search ..... 250/281–283, 250/287–288, 423 P

(56) References Cited

U.S. PATENT DOCUMENTS 5,382,794 A * 1/1995 Downey et al. ..... 250/288
5,631,462 A * 5/1997 Reents, Jr. ..... 250/288
5,977,540 A * 11/1999 Reents, Jr. ..... 250/288
5,988,215 A * 11/1999 Martin et al. ..... 137/613
6,259,101 B1 * 7/2001 Wexler et al. ..... 250/423 P
6,518,568 B1 * 2/2003 Kovtoun et al. ..... 250/287
6,683,289 B2 * 1/2004 Whitmore et al. ..... 219/730

* cited by examiner

*Primary Examiner*—John R. Lee
*Assistant Examiner*—Christopher M. Kalivoda
(74) *Attorney, Agent, or Firm*—David W. Herring, Jr.

(57) ABSTRACT

A method for determining the shape and size of particles and their constituent elements is disclosed. Particle ions are accelerated through a mass spectrometer useful in identifying the source particle of the resulting ions. By measuring the time-varying intensity of the identified ions as they strike a detector, a plot of the intensity of the ions over time is obtained for each ionized particle. The size of each ionized particle is determined by measuring a time span corresponding to the width of the peak of this plot. If the detector is a phosphor detector, the shape of the particle may be determined by using a high-speed camera to capture cross-section images of the ion-induced light pattern at closely-spaced successive moments in time. Alternatively, the intensity of ions striking the detector along at least one lateral dimension may be detected. By combining the multiple cross section images or the multiple lateral direction intensity profiles that are thus captured, an actual image of the shape of the original particle can be obtained.

5 Claims, 9 Drawing Sheets

CHARACTERIZATION OF INDIVIDUAL PARTICLE ATOMIC COMPOSITION BY AEROSOL MASS SPECTROMETRY

FIELD OF THE INVENTION

The present invention relates to mass spectrometry and, more particularly, to the detailed characterization of individual particles by mass spectrometry.

BACKGROUND OF THE INVENTION

Particle analysis is important in a wide variety of industrial processes including the fabrication of high performance semiconductor and optoelectronic devices. As feature sizes on semiconductor devices shrink, the size of particles that causes defects also decreases. On today's advanced devices, particles as small as 0.1 micrometers can cause yield reducing defects. In the near future, as feature sizes on devices become smaller and smaller, particles as small as 0.02 micrometers will result in significant defects. Such particles can come from several sources including delaminating films, broken wafers, atmospheric dust, and the vacuum processes used for the deposition and etching of thin films, especially plasma processes. Analysis of the chemical composition of the particles is an important step in finding the root cause of particle contamination.

There now exist highly accurate techniques for detecting and analyzing sub-micron particles. Such techniques are described in U.S. Pat. No. 5,382,794 issued to S. W. Downey et al. on Jan. 17, 1995 and U.S. Pat. No. 5,631,462 issued to one of the present inventors W. D. Reents, Jr. on May 20, 1997, both of which are incorporated herein by reference. In essence, the particles are entrained within a gas stream, fragmented and ionized by a laser beam ("laser ablation"), and the chemical nature and concentration of the species within the particle is determined by mass spectrometry. This approach permits limited real-time characterization of particles as small as 1 nm in diameter.

Although such previous efforts are useful in many situations, they are not capable of providing detailed information concerning the size and shape of a particle nor can they provide information concerning the relative positions of elements within the particles.

SUMMARY OF THE INVENTION

We have recognized that, while the '794 and '462 patents provide exemplary methods for obtaining limited types of particle-related information, there remains a need to provide a method for obtaining more detailed information such as, for example, the size, shape, and relative position of elements within particles. Such detailed information greatly enhances the ability to identify the origination point and nature of the particles in question by providing the crucial information needed, for example, to identify and isolate the source of the particles.

Therefore, we have invented a method for determining the shape and size of particles and the distribution of bulk constituent elements within those particles. Specifically, in a first aspect of the invention, a particle is ionized using a laser with sufficient power to fragment and ionize substantially all elements of the particle. The resulting ions are sampled by a mass spectrometer useful in identifying the bulk chemical composition of the source particle. The time-varying intensity of the mass-resolved ions are measured as they strike a detector. The integrated intensity over time for each ion mass is related to the total number of ions that existed in the source particle prior to ablation. The temporal width of a mass-resolved ions' intensity is related to the diameter of the original particle.

In another aspect of the invention, the shape and the relative position of each constituent element of a particle can be determined. In accordance with this aspect, as described above, substantially all the elements of a particle are ionized and the ions of each particle are identified by mass spectrometry. The intensity of the ions impacting a detector over time is measured for each element in order to develop a series of intensity vs. time plots corresponding to the ions of each element within the source particle. The plots of intensity versus time represent the one-dimensional spatial distribution of the ions just prior to impact with the detector. Since the final spatial distribution of ions is related to the initial one-dimensional distribution of elements within the particle, the shape of the intensity versus time plot itself is directly related to the one-dimensional shape of the particle source and the distribution of each of its elements within the source particle. Thus, by comparing the plots of the different elements relative to each other, the cumulative shape of the original particle with those elements can be determined.

In yet another aspect of the invention, the one-dimensional to three-dimensional shape and relative position of the particle and its constituent elements can be determined by photographing a phosphor screen detector that emits light at those points where ions impact the surface of the detector. This image reflects a two-dimensional (defined by the plane of the detector) image of the spatial location of the ions as they arrive to the detector. A high-speed camera captures images of the resulting light pattern at closely-spaced successive moments in time. These images represent the cross section of the original particle at each moment in time. Successive images in time represent the third dimension of the spatial location of the mass-resolved ions in a manner similar to the previous description of the invention. By combining the multiple time-resolved cross section images that are thus captured, a three-dimensional image of the elemental distribution within the original particle is obtained. By overlaying the three-dimensional images for each element in the particle, the complete shape of the original particle can be obtained.

DETAILED DESCRIPTION OF THE INVENTION

Figure 1:
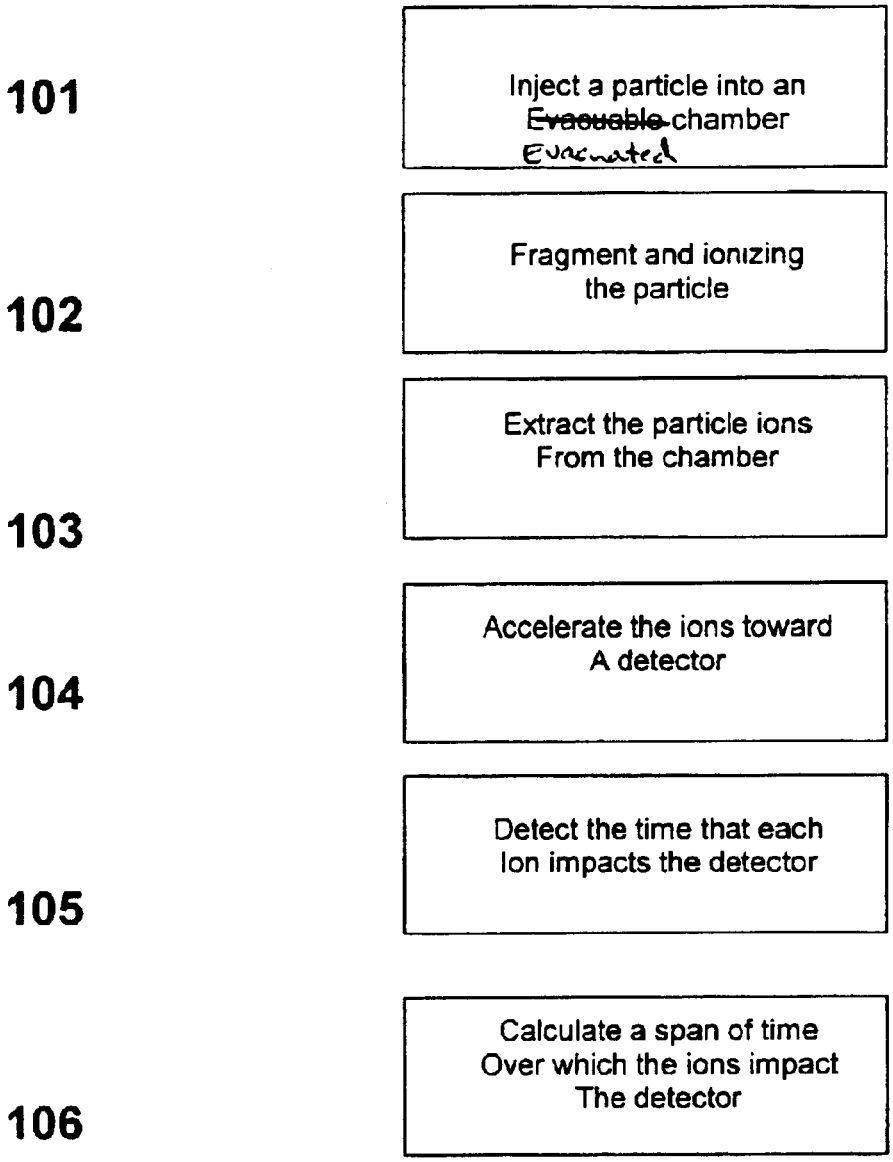
FIG. 1 shows a method in accordance with the principles of the present invention whereby the size of a particle is determined.

FIG. 1 shows the steps of a method in accordance with one embodiment of the present invention wherein the size of a small particle may be determined. At step 101, a particle is injected into an evacuated chamber. At step 102, the particle is fragmented and the elemental constituents are ionized, exemplarily by being exposed to a focused high-powered laser beam. At step 103, the resulting ions are extracted from the chamber and, at step 104, are accelerated toward a detector which is, for example, a component of a mass spectrometer. At step 105, the time that each mass-separated ion impacts the detector is detected and at step 106, the intensity of the mass-separated ions versus time is used to calculate the size, shape, elemental composition, and element distribution of and within the original particle from which the ions were created.

Figure 2:
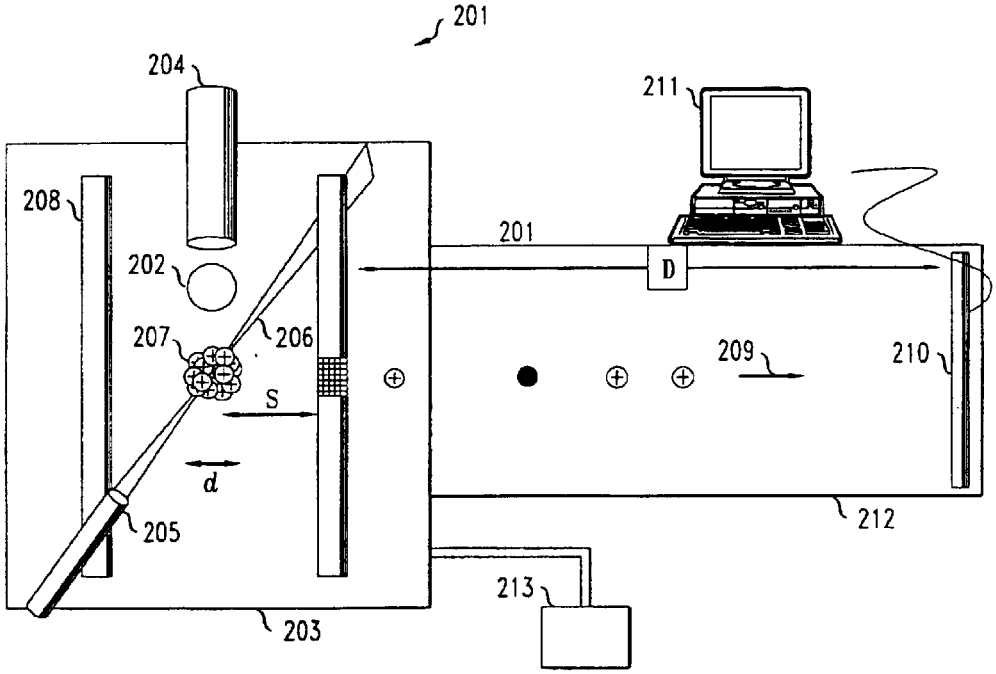
FIG. 2 (PRIOR ART)
FIG. 2 shows a first prior art apparatus used to ionize particles and obtain particle mass spectra information.

FIG. 2 shows an illustrative apparatus useful with the method of FIG. 1. This apparatus fragments and ionizes particles and then accelerates the resulting ions toward a well-known mass spectromter. An illustration of this apparatus is the subject of U.S. Pat. No. 5,977,540 issued to the present inventor W. D. Reents, Jr. on Nov. 2, 1999 which is hereby incorporated by reference in its entirety. The apparatus 201 includes an inlet device 204 through which particles enter a differentially pumped chamber 203. Chamber 203 is generally maintained at a pressure at or below approximately $10^{-3}$ torr by a vacuum pumping system 213. One skilled in the art will recognize that pumping system 213 may be selected from any device capable of maintaining vacuum in the desired range and may be, for example, a mechanical pump, a diffusion pump, cryogenic pump, turbomolecular pump or combinations thereof.

Capillary 204 is used to transport a particle-laden gas stream into chamber 203 and is preferably fabricated from materials which provide a smooth interior surface, such as fused silica. Typically, the inner diameter of the capillary 204 is on the order of 0.05 to 0.53 mm with a length of approximately 0.1 to 10 meters. The use of an inlet capillary 204 of these dimensions assists in collimating the particle-laden gas stream and advantageously eliminates the need for mechanical pumping along the path of the capillary.

To ionize the particles injected through capillary 204, a laser 205 is positioned such that a laser beam 206 intersects the position of the particles, such as particle 202, as they enter chamber 203. Although not depicted to scale in FIG. 2, the cross-sectional area of the beam 206 is at least as large as the cross-sectional area of the particle-laden stream carrying particle 202 at the point of intersection between the beam and the stream. Laser 205 is selected from pulsed lasers having a short pulse width, a high peak power, a moderate spot size, and a high repetition rate. For the embodiment shown in FIG. 2, laser 205 has a pulse frequency of from 10 Hz to 100 kHz. The laser power is at least approximately 10 mJ with a power density on the order of $1.0\times10^{10}$ W/cm$^2$, preferably greater than $1.0\times10^{13}$ W/cm$^2$. Laser spot sizes are determined by the selected laser power and power density. Typically, laser spot sizes range between 0.003 mm$^2$ to 0.1 mm$^2$.

The use of the above-described high laser power densities enables the full characterization of the particle-laden gas stream because such high powers ensure mass-independent ablation of the elemental constituents of the particle along with ionization of all of the elements, including high-ionization potential elements. Prior attempts to chemically analyze particles using laser ablation did not easily ionize these high potential elements and, thus, tended to be overly sensitive to certain elemental species. Additionally, smaller particles, which are more difficult to ablate and ionize (since their cross-sections for absorbing laser-energy are smaller that that for larger particles), ionize more readily at the higher laser power densities referenced above. Upon the introduction of the particle-laden gas stream into chamber 203, laser 205 is powered on and fired at a certain frequency. As particle 202 enters the chamber 203, it passes through the region where the laser beam 206 is focused. When the particle crosses the focus-region, the laser beam fragments particle 202 into its constituent elements, and ionizes each of the corresponding elements to form ions 207. For the high power densities of the present invention, ions 207 are positive ions.

Ions 207 are extracted from the chamber by a positively-charged extraction plate 208 that is an average distance S away from the ions 207. The extraction plate 208 accelerates the ions into a time-of-flight mass spectrometer 212 with detector 210. The spectrometer 212 obtains the mass spectra information of the particles ionized by the laser 205. One skilled in the art will recognize that a variety of mass spectrometers, such as quadrupole, magnetic-sector spectrometers or other mass spectrometers, can be used to detect the ions. The spectrometer 212 obtains such spectra information by counting each ion incident upon detector 210 and measuring the time at which the ion struck the detector 210 relative to the time at which the particle was ablated and ionized by the laser beam. The time-of-flight of a particular ion correlates to the mass of the ions, the voltage on the extraction plate 208, and distance D over which the ions have to travel. Computer 211 or another well-known means may be used to plot the collected time-of-flight spectra information and may, exemplarily generate a plot of the intensity (number) of ions striking the detector 210 as a function of measured time and calculated mass.

Ions 207 are spread over a lateral distance d and, therefore, some ions are located closer to the extraction plate 208 than other ions. The ions further from the extraction plate 208 are thus accelerated to a greater kinetic energy than those ions closer to the extraction plate. The energy of a given ion may be expressed as:

$$E_{total}=E_{inst}+\Delta E \qquad \text{(Equation 1)}$$

where $E_{total}$ is the total kinetic energy of a particular ion at any point in the ionization region, $E_{inst}$ is the initial energy of an ion located at a nominal distance S from the extraction plate 208, and $\Delta E$ is the difference in energy attributed to the different distances of particular ions from the extraction plate 208. An ion's flight time down the flight path 209 is defined by the ion's total kinetic energy and the ion's mass; for iso-energetic ions, high-mass ions take longer to arrive at detector 210 than low-mass ions. At the instant of laser ablation and ionization, the initial spatial distribution of the ions is related to the initial position of the elements in the original particle, and therefore gives a distribution of total kinetic energies, $E_{total}$. The variation in total energy due to initial spatial distributions results in a temporal spread of the time-of-flight of the individual ions, even for ions having the same mass.

Figure 3:
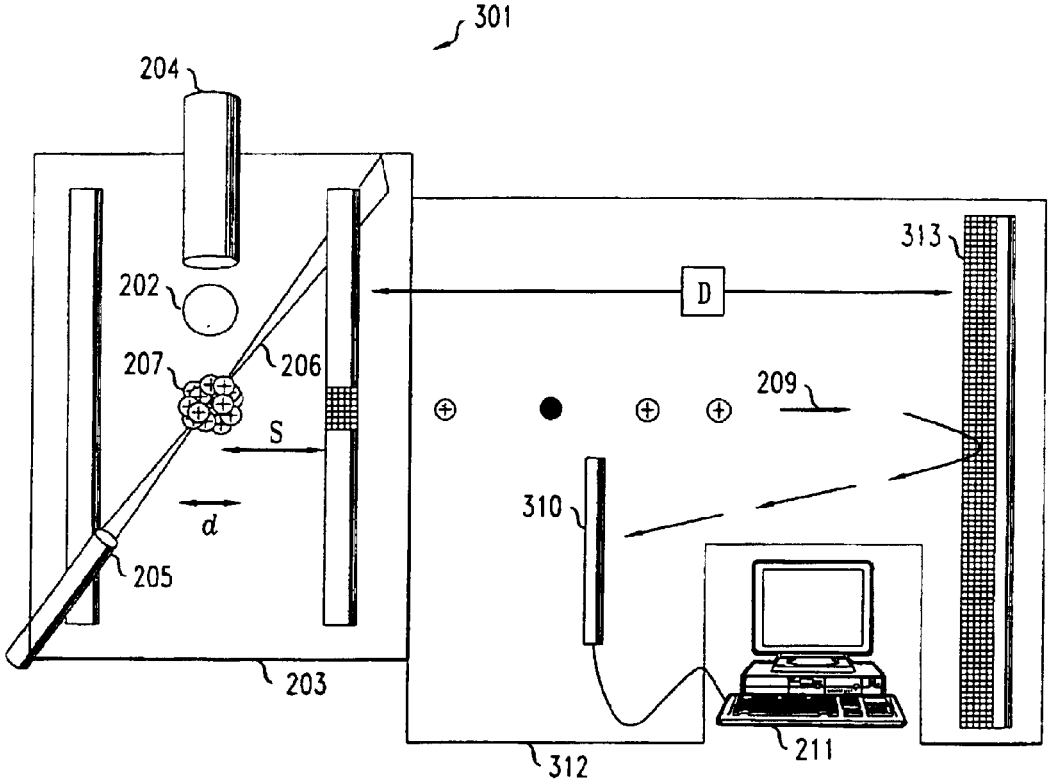
FIG. 3 (PRIOR ART)
FIG. 3 shows a second prior art apparatus used to ionize particles and obtain particle mass spectra information.

FIG. 3 illustrates one apparatus that is able to compensate for the temporal spread of ions due to initial spatial distributions in the ionization region. Specifically, FIG. 3 shows the apparatus of FIG. 2 except that in FIG. 3, a reflectron 313 is used to compensate for the variation in kinetic energy described above or, in other words, correct for the ΔE component of Equation 1. Such reflectrons, well-known in the art, correct for this energy difference by causing higher-energy ions (ΔE>0) to travel a longer distance than shorter-energy ions (ΔE<0), thereby causing the total flight time of both the higher and lower energy ions of the same mass to be the same.

Figure 4A:
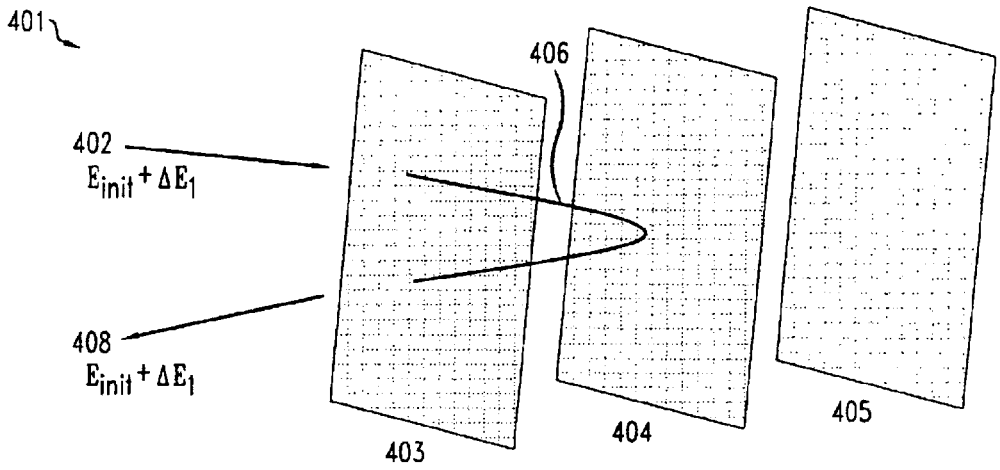
FIG. 4A (PRIOR ART)
FIG. 4A and FIG. 4B show the operation of a reflectron as used in the apparatus of FIG. 3.
Figure 4B:
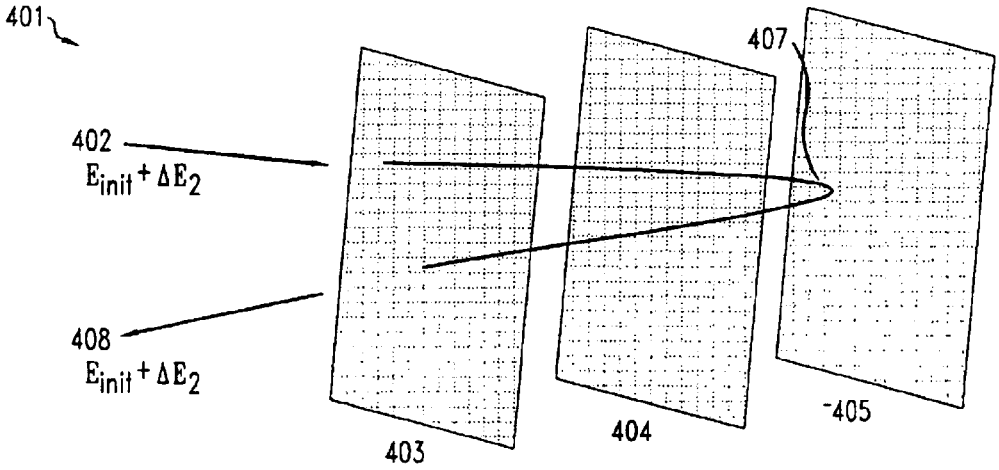
FIG. 4B (PRIOR ART)

FIGS. 4A and 4B depict the function of such a reflectron. Namely, referring to FIG. 4A, reflectron 401 comprises a series of electric fields, depicted as screens 403, 404 and 405, each having a different voltage. The voltages are selected in a way such that $V_{403}<V_{404}<V_{405}$ where $V_{405}$ is selected to be slightly higher than that voltage at which the ions with the highest anticipated energy levels will be prevented from penetrating screen 405. An ion with a kinetic energy according to Equation 1 equal to $E_{init}+\Delta E_1$, traveling in direction 402 will penetrate to depth 406 within the reflectron before being repelled by the electric field caused by voltages $V_{403}$, $V_{404}$, $V_{405}$ of the screens of the reflectron. Referring to FIG. 4B, an ion with kinetic energy $E_{init}+\Delta E_2$, where $\Delta E_2>\Delta E_1$, travels along path 402 toward reflectron 401. Since the kinetic energy of this ion is higher than that in FIG. 4A, it will penetrate the reflectron to depth 407 (which is deeper than depth 406 in FIG. 4A) before being repelled by the electric field of the reflectron. The effect of this field in both FIG. 4A and FIG. 4B is to lengthen the pathlength for the higher energy ions; when $\Delta E_2>\Delta E_1$ due to initial variation in position within chamber 203 in FIG. 2. The ions will emerge from the reflectron traveling in direction 408 with their same original energies $E_{total}$, however their path lengths will have been modified. Therefore, the time-of-flight bias caused by the variation in total energy is corrected and, ideally, each ion of the same mass will arrive at the detector 310 at precisely the same time giving an extremely high signal to noise performance for the time-of-flight mass spectrometer 312 in FIG. 3.

Referring once again to FIG. 3, the ions that emerge from reflectron 313 will strike detector 310 and mass spectral information will be obtained and processed by computer 211 or other suitable means as described above. As described, the use of the reflectron would otherwise erase all information relating to a particles shape, size, and elemental distribution within the original particle, of which are claims to this invention. In practice, however, it is not possible to have multiple ions with identical mass impact the detector 210 or 310, in FIG. 2, or FIG. 3, respectively, at precisely the same time because of space-charge limitations. Specifically, Coulomb repulsion forces, well understood in the art, cause ions with like charges to expand away from each other. These forces, which are in part due to the initial positions of ions within the particle at the point of ablation and ionization, are not corrected for by the reflectron 313. Therefore, even with the reflectron, there will be a temporal distribution of the arrival of ions at the detector 310 due to Coulomb expansion. The total energy of the ions at the point of creation in the evacuated chamber 203 will have a spatially-dependant variation due to the position of the ions within the extraction electric field, and a spatially-dependant variation due to each ion's position relative to all neighboring ions in the ion cloud at the point of ablation and ionization. The reflectron nominally corrects for only the first of the spatial dependencies, leaving the second to give a variation in the arrival time at detector 310, and hence, a representation of the inital distribution of ions in the original particle relative to each other.

Figure 5:
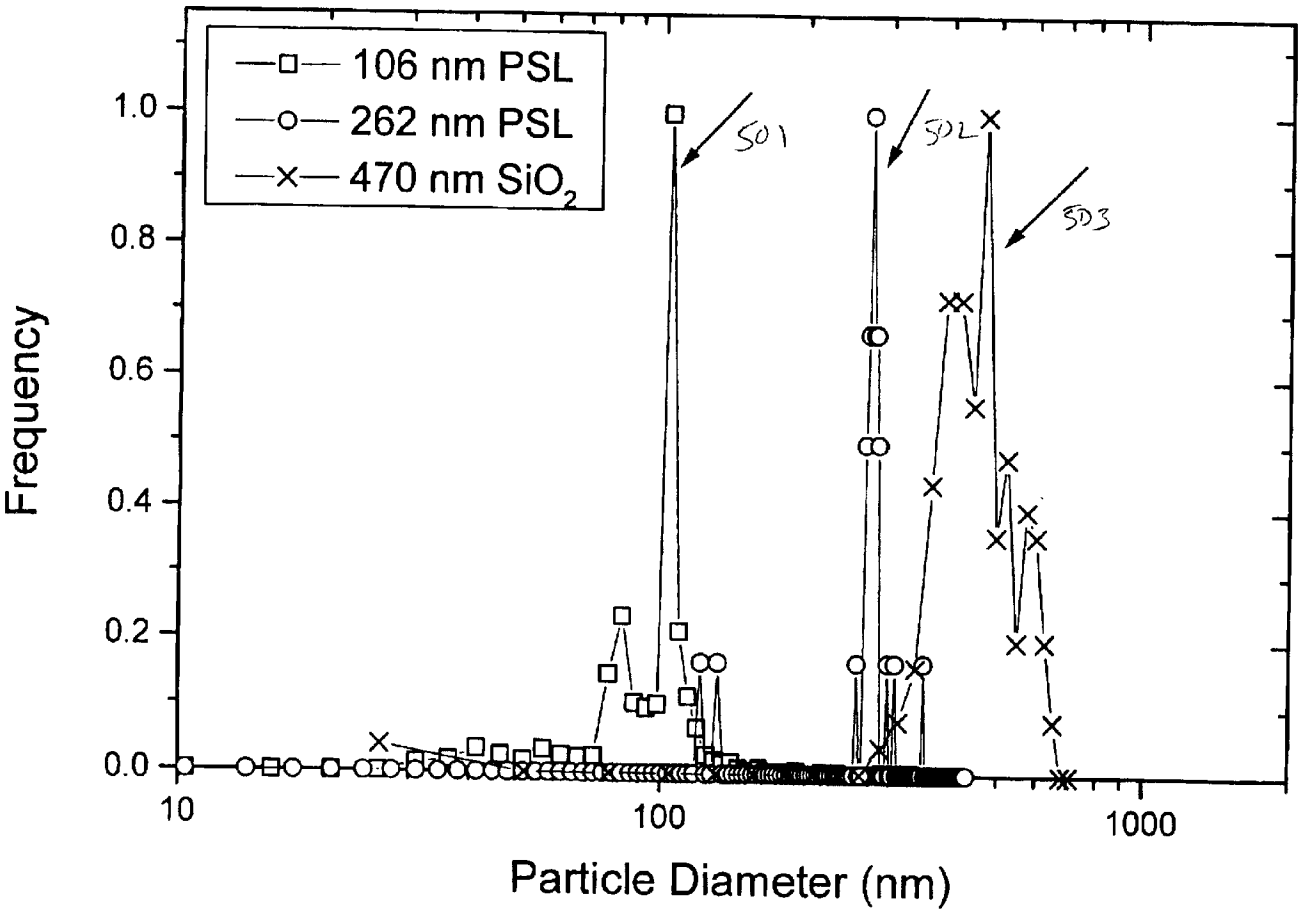
FIG. 5 shows a plot in accordance with the principles of the present invention useful in obtaining particle size information.

FIG. 5 shows the particle diameter for three different particle sets introduced into the apparatus of FIG. 3, calculated from the temporal width of the arrival time of ions from each particle. Specifically, plot 501 shows the distribution of particle diameters obtained from an ensemble of sampled National Institute of Standards and Technology (NIST)-calibrated polystyrene latex spheres, which are well known in the art, having an average diameter of 106 nm; plot 502 shows the distribution of particle diameters obtained from an ensemble of sampled NIST-calibrated polystyrene latex spheres with an average diameter of 262 nm; and plot 503 shows the distribution of particle diameters obtained from an ensemble of sampled NIST-calibrated silicon dioxide particles with an average diameter of 470 nm. The present inventors have realized that, when a high percentage of the particles are fragmented and ionized in accordance with the above-described embodiments, the temporal widths of the flight time of iso-mass ions correlate to the size of the original particles prior to ionization, as displayed by plots 501, 502, and 503. Specifically, the size of the original particle can be derived from this information according to the following relationship:

$$\text{diameter} = \beta * \Delta t = \beta * n^{1/3}\sqrt{\frac{m}{z}} \qquad \text{(Equation 2)}$$

where n is the number of ions striking the detector in the mass spectrometer, m is the mass of those ions, z is the electrical charge of the ions, β is a proportionality constant related to the parameters used to operate the mass spectrometer, and Δt is the time span over which equal-mass ions strike the detector. Each of n, m, and z are obtained from the results of the above-referenced mass spectrometry method.

The proportionality constant, β, is calculated from mass spectrometry of a particle with a known size. Referring once again to FIG. 5, the ensemble of peak widths for the silicon dioxide particles of plot 503 were measured from the Si+ ion. The average peak width calculated from that distribution, 290 ns, was fit to the known 470 nm diameter of the NIST-calibrated silicon dioxide particle. Proportionality constant β equates the measured average peak width to the known diameter. This constant β was 1.7 for the set of parameters used to operate the mass spectrometer in the case represented by FIG. 5. Using this constant in Equation 2, the particle diameter of the 106 nm polystyrene latex spheres was calculated from the width of the Carbon $1^+$ ion sampled from an ensemble of those spheres. The distribution of peak widths for this particle ensemble is shown in plot 501. The most frequently occurring particle diameter in plot 501 was 104 nm, as compared with the expected value of 106 nm. For the polystyrene latex particles represented by plot 502, a similar approach was taken, again using the same calibration factor, β=1.7. From the peak in the distribution, calculated from that particles distribution of Carbon 1+ ion peak widths, the diameter of the particles is calculated as 273 nm, compared to a known diameter of 262 nm.

Figure 6:
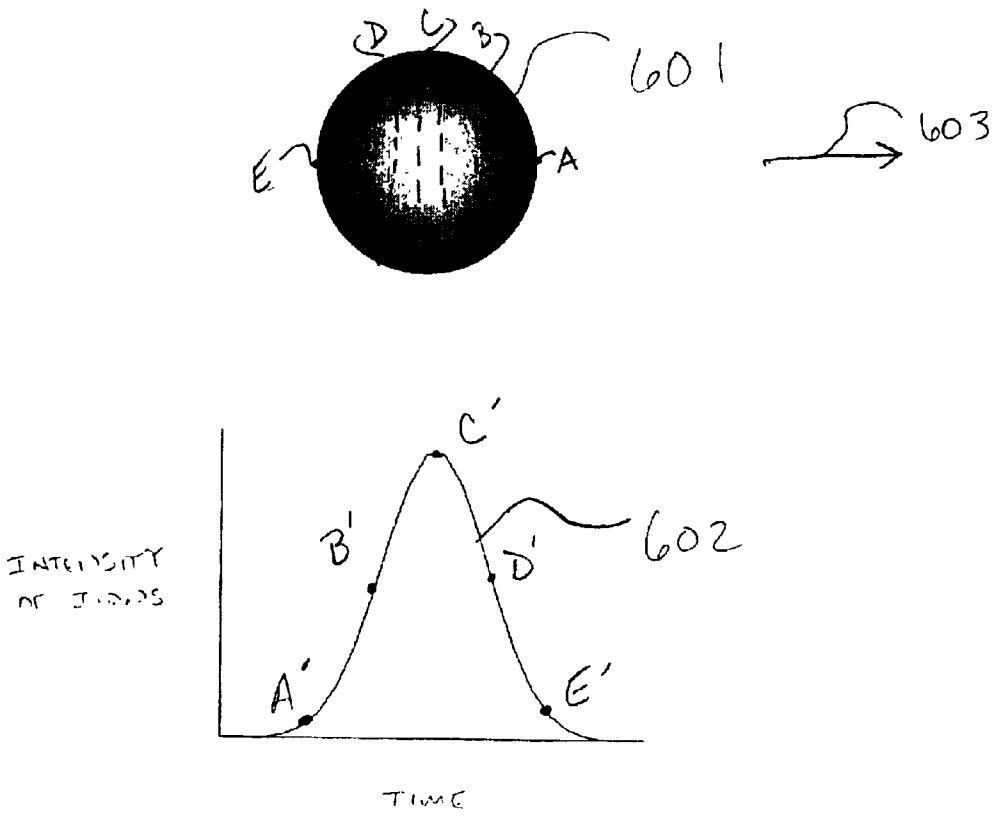
FIG. 6 shows an illustrative plot of the intensity of ions of a spherical particle as they strike a detector over time.

In addition to calculating the size of particles by utilizing data collected during mass spectrometry, similar methods may be employed in determining the shape and relative positions of elements within the particles. To illustrate a first embodiment of how shape may be determined from mass spectrometry, FIG. 6 shows a sphere-shaped particle 601 and a corresponding plot 602 of the intensity of ions impacting a detector as a function of time. When the particle is fragmented, ionized, and accelerated into a mass spectrometer, as described above, the intensity of the ions striking the detector over time provides distinct information that directly corresponds to the one-dimensional shape of the particle. This is only true for the case where, as in the above-described method, a large percentage of the particles are ionized. Additionally, undistorted information is most readily obtained by using a device such as the reflectron of FIG. 3 to remove the bias due to the ions' position relative to the extraction plate.

Referring again to FIG. 6, plot 602 corresponds directly to the cross-section of the spherical shape of particle 601. Specifically if the ions of particle 601 were moving in direction 603 as they struck a detector, a low number of ions, corresponding to the minimum cross section of sphere 601 represented by point A, would strike the detector first. This low number of ions is represented by point A' on plot 602. As the cross section of the particle increases, the number of ions generated from that portion of the particle also increase. Thus, points B', C', D' and E' on plot 602 correspond to the ions generated by particle cross sections B, C, D and E, respectively, with point C' representing the maximum intensity of ions, since cross section C is the maximum cross section of particle 601. The same general plot will result for any spherical ionized particle. One skilled in the art will recognize that each point on plot 602 correlates to the surface area of a cross section of the particle 601. It follows that the slope of the plot at each of these points corresponds to the rate of change of the cross section of the particle 601. Combining the instantaneous cross section information with this rate of change information makes it possible to reconstruct the shape of the original particle prior to ionization. Thus, when a substantial portion of all particles entering chamber 203 in FIG. 3 are ionized, the shape of those particles may be determined without foreknowledge of their characteristics.

Figure 7:
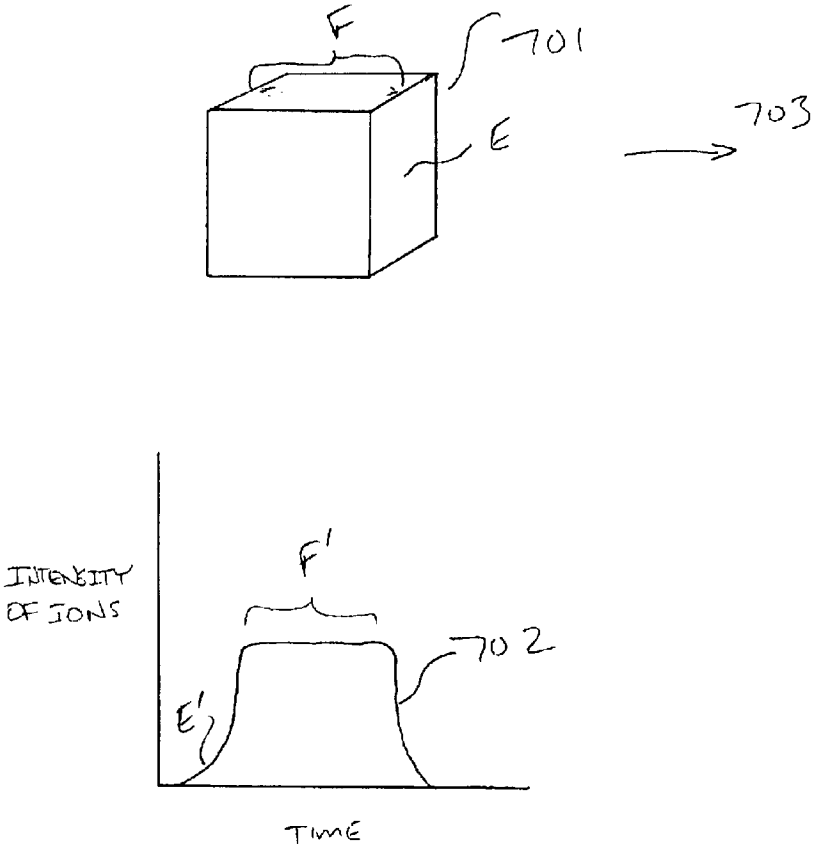
FIG. 7 shows an illustrative plot of the intensity of ions of a cubic particle as they strike a detector over time.

FIG. 7 shows another illustrative example of a graph corresponding to the shape of a particle. Specifically, particle 701 is cubic and, thus, is of constant cross section. For the case where the ions of particle 701 are traveling in direction 703 toward a detector, plot 702, therefore, is characterized by a rise beginning at point E', corresponding to the impact of the ions from side E of the particle, followed by a plateau F' representing the impact of the ions from the central portion F of the particle. This plateau is directly the result of the constant cross sectional area of particle 701.

Figure 8:
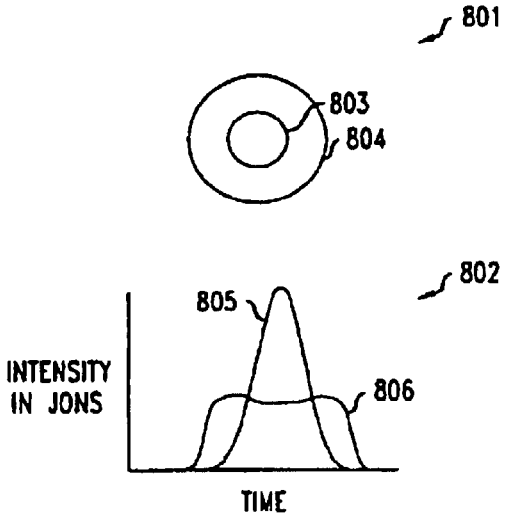
FIG. 8 shows the plot of the intensity of ions of a shell-coated spherical particle as they strike a detector over time.

FIG. 8 shows how relatively complex particles may be characterized in their shape by methods similar to those described in FIGS. 6 and 7. Specifically, FIG. 8 shows a spherical particle 801 with a shell 804 composed of a different element than the central sphere 803. When this particle 801 is ionized according to the above-described process, the ions of the two different substances are intermixed. Mass spectrometry, however, differentiates between particles having a different mass, making it possible to measure the intensity over time of each of the element's ions as they strike a detector at different times. Therefore, graph 802 will show two distinct plots with plot 805 representing the ions of sphere 803 and plot 806 representing the ions of the outer shell 804. As before, each point on plots 805 and 806 correlates to the cross sectional area of the corresponding component of the particle (i.e., the shell and the core) and the slope of the plot of each of those points corresponds to the rate of change of the area of that component. Thus it is possible to reconstruct the physical shape of the particle and arrangement of the different components of that particle.

Figure 9:
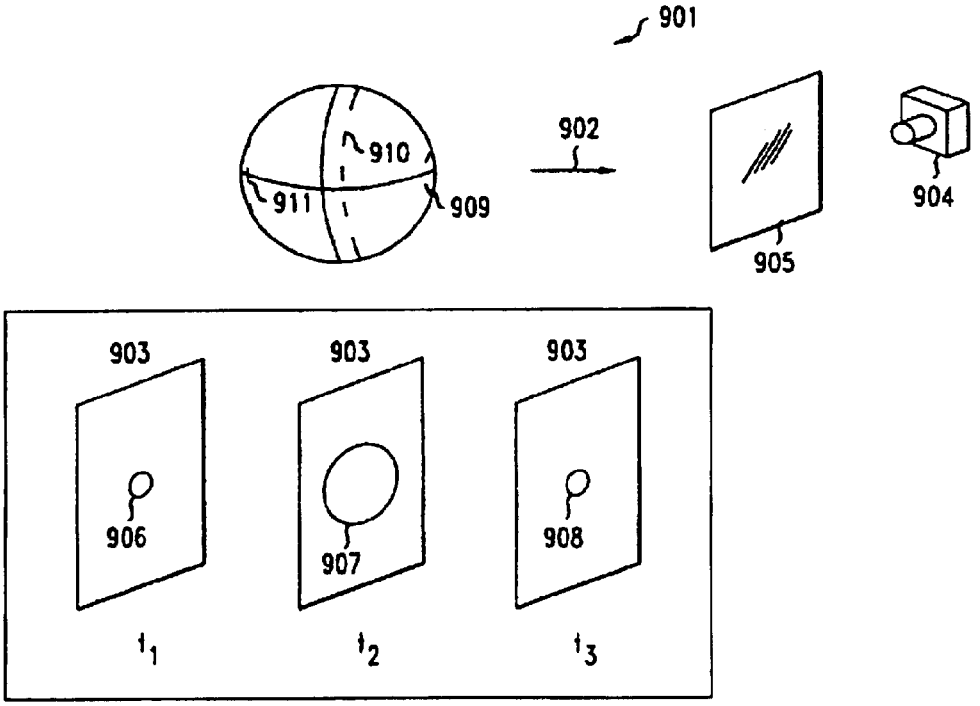
FIG. 9 shows a first method of determining the shape of a particle by using mass spectra information and images of a detector over time.

FIG. 9 shows a second embodiment in accordance with the present invention showing how the multi-dimensional shape of a particle may be measured using the information obtained via the above-described mass spectrometry. Once again, particle 901 is ionized and the resulting ions are accelerated in direction 902 toward detector 903. Detector 903 illustratively contains particles that emit light when ions strike the detector. A high speed camera is positioned in a way such that images of this light pattern on detector 903 may be captured over time. At a particular point in time, the light pattern corresponds to a distinct element located at the cross section of the original particle prior to ionization. As the ions of particle 901 travel in direction 902, they strike detector 903. Thus, at time $t_1$, the ions of a particular mass corresponding to cross section 909 strike detector 903, causing the image 906 that can be captured by the high speed camera. Similar images 907 and 908 are obtained at times $t_2$ and $t_3$, respectively, corresponding to the image of the number of ions from the larger cross section 910 imaged at $t_2$ followed by the image resulting from the ions of the smaller cross section 911. By comparing the successive images of the cross section of the particle 901, it is possible to reconstruct the distribution of any single element within the original particle. By comparing the reconstructions of multiple ions, it is possible to reconstruct the complete shape of the original particle.

Figure 10:
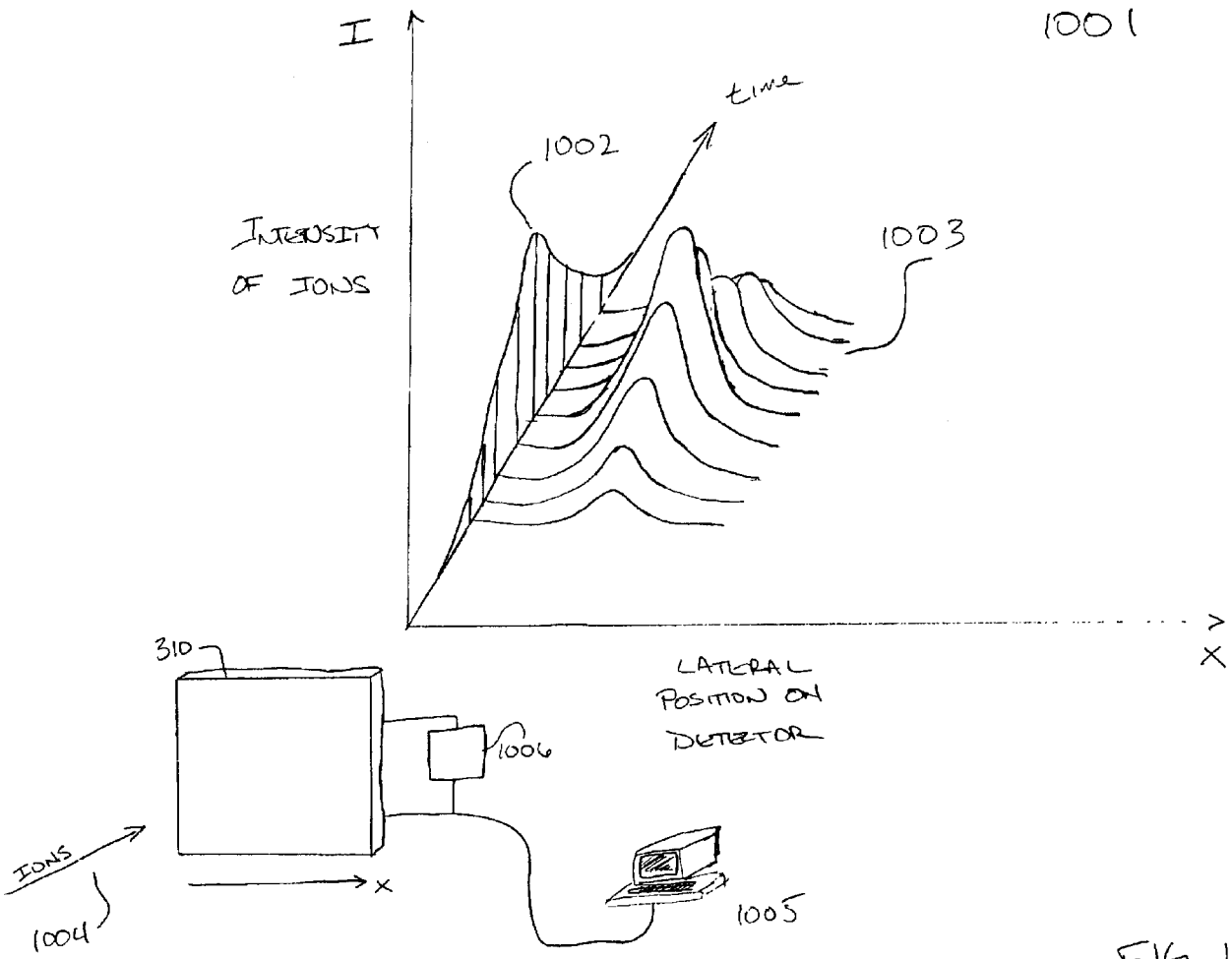
FIG. 10 shows a second method of determining the shape of a particle by using mass spectra information ion impact positional information over time.

FIG. 10 shows another embodiment in accordance with the principles of the present invention whereby the shapes of complex particles are determined. Specifically, ions from a spherical particle, such as particle 901 in FIG. 9, travel in direction 1004 toward a detector, such as detector 310 in FIG. 3. As previously described above, when the different species of ions strike detector 310, the intensity of ions of that species striking the detector over time may be plotted, for example with computer 1005, to produce a plot, such as plot 1002. This plot 1002 represents the total number of ions of that species that struck the detector at each particular time. While such a plot can yield general one-dimensional information about the size and shape of the original particle, it is easier and more accurate to compare this with the two-dimensional intensity information from the intensity profile of the ions across the lateral dimensions x and/or y of the face of the detector. Such a profile can be obtained, for example, by using a positional detector 1006 to detect the intensity of ions impacting detector 310 at each point along lateral dimensions x and/or y as a function of time. Thus, at each instant in time, profiles 1003 are obtained corresponding to the detected ions from a particular cross section of the particle. Profiles 1003 provide much the same information as do the photographic images taken by the high speed camera of the embodiment of FIG. 9. By comparing the two dimensional time vs. intensity plot 1002 with plots 1003, an accurate three-dimensional representation of the original particle, such as particle 901 in FIG. 9, may be obtained.

The foregoing merely illustrates the principles of the invention. It will thus be appreciated that those skilled in the art will be able to devise various arrangements which, although not explicitly described or shown herein, embody the principles of the invention and are within its spirit and scope. Furthermore, all examples and conditional language recited herein are intended expressly to be only for pedagogical purposes to aid the reader in understanding the principles of the invention and are to be construed as being without limitation to such specifically recited examples and conditions. Moreover, all statements herein reciting aspects and embodiments of the invention, as well as specific examples thereof, are intended to encompass functional equivalents thereof.

What is claimed is:

1. A method for determining the shape of a small particle comprising:

fragmenting and ionizing the particle;

accelerating toward a detector a portion of the ions of at least a first ionized species of said ionized particle;

detecting the time and location along at least a first dimension of said detector that each ion of said portion of ions impact said detector; and determining the shape of said particle as a function of said time and location.

2. The method of claim 1 wherein said particles are fragmented and ionized by a laser beam.

3. The method of claim 1 wherein, after the accelerating step, said method further comprises compensating for a temporal spread of said portion of ions by causing said ions to be incident upon at least a first surface of a reflectron.

4. A method for determining the shape of a small particle comprising:

fragmenting and ionizing the particle;

accelerating toward a detector a portion of the ions of at least a first ionized species of said ionized particle;

wherein, upon being struck by at least a first ion, said detector emits at least a first indication capable of being imaged that said ion has struck the detector; and generating at least a first image of the surface of said detector as said ions impact said detector; wherein said at least a first image represents at least one portion of the shape of said particle.

5. The method of claim 4 wherein, after the accelerating step, said method further comprises compensating for a temporal spread of said portion of ions by causing said ions to be incident upon at least a first surface of a reflectron.

* * * * *